US005911335A

United States Patent [19]

Baumann

[11] Patent Number: 5,911,335

[45] Date of Patent: Jun. 15, 1999

[54] LINER CHOKER

[76] Inventor: Peter J. Baumann, 2437 31st Ave. S., Minneapolis, Minn. 55406

[21] Appl. No.: 08/946,081

[22] Filed: Oct. 7, 1997

[51] Int. Cl.[6] ..... B65D 25/00

[52] U.S. Cl. ..... 220/495.11; 220/908.1

[58] Field of Search ..... 220/495.6, 495.08, 220/495.11, 908.1

[56] References Cited

U.S. PATENT DOCUMENTS

| | | | |
|---|---|---|---|
| 2,678,764 | 5/1954 | Carlson | 220/495.11 X |
| 4,027,774 | 6/1977 | Cote | 220/495.11 |
| 4,570,304 | 2/1986 | Montreuil et al. | 220/495.11 X |
| 4,576,310 | 3/1986 | Isgar | 220/908.1 X |
| 4,919,374 | 4/1990 | Julian | 220/495.11 X |
| 4,923,087 | 5/1990 | Burrows | 220/908.1 X |
| 5,314,151 | 5/1994 | Carter-Mann | 248/100 |
| 5,349,710 | 9/1994 | Dunn | 5/503.1 |
| 5,556,063 | 9/1996 | Boyd | 248/99 |
| 5,611,507 | 3/1997 | Smith | 248/99 |
| 5,690,247 | 11/1997 | Boover | 220/495.11 |
| 5,695,088 | 12/1997 | Kasbohm | 220/495.11 |

*Primary Examiner*—Steven Pollard

*Attorney, Agent, or Firm*—Patent & Trademark Service; Thomas Zack; Joseph H. McGlynn

[57] ABSTRACT

A retainer device for a removable container liner, such as a disposable plastic bag, used in conjunction with a container. The retainer consists of hollow cylinder with opened ends having a side cutout segment that joins with a smaller second inwardly tapered cutout segment which second segment is oriented substantially parallel to the front opened end of the retainer and, when mounted on a container, the container's side. To use the device part of the liner's excess amount is first pulled by its exposed edge through the front opened hollow end and interior of the retainer. Next, the pulled exposed edge is wedged into the retainer's tapered cut out section to tension and retain it with respect to the retainer and, if mounted on, the side of the container. A coating of elasticized paint may be used near the smaller tapered cutout segment to assist in the retaining in place of the liner contacted liner material.

6 Claims, 1 Drawing Sheet

LINER CHOKER

BACKGROUND OF THE INVENTION

Liners for trash containers, usually plastic bags, come in several different sizes to fit standard sized containers. When the inserted liner is too large for the container its opened edge extends over the container's opened rim. In this situation as more and more garbage or other trash is placed into the liner within the container the unsecured liner edge may eventually slip into the container providing a dirty retrieval problem to the user. To prevent the liner's edge from falling into the container, liner retaining devices have been designed. These liner retaining devices usually engage the container's rim or the outside of the container to retain the liner's exposed edge from falling into the interior of the container. The present invention relates to one such one piece liner retaining device that is easy to use, compact in its construction and inexpensive to manufacture all as detailed herein.

DESCRIPTION OF THE PRIOR ART

Liner retainers are known in the prior art. For example, in U.S. Pat. No. 5,314,151 to Carter-Mann a hanger clip device for a plastic bag is disclosed which fits over the container's rim such that its protruding flange engages the bag's edges.

In the Dunn invention (U.S. Pat. No. 5,349,710) a retaining device is provided which has a series of grippers to maintain a bag.

The Boyd reference (U.S. Pat. No. 5,556,063) discloses a trash bag retaining band with an expandable ring with handle grips.

In U.S. Pat. No. 5,611,507 to Smith the bag's edge is anchored on the container's exterior surface by a series of spaced clips having movable arms. The present invention differs from this and the known prior art by providing for a one piece open ended hollow body device having cut out segments at least one of which is tapered to permit the wedging of excess liner material therein to retain the liner all as set forth in this specification.

SUMMARY OF THE INVENTION

This invention relates to removable liner, such as a plastic bag, retainer used in conjunction with a container. The liner retainer consists of hollow cylinder with two opened opposite ends having a first side cutout segment that joins with a second smaller inwardly tapered cutout segment. This second segment is oriented substantially parallel to a retainer's opened front end edge and can be mounted on a container's side. Before being mounted on the container, a part of the liner's exposed excess edge is grasped by a user's hand and pulled through the hollow interior of the retainer to tension the liner. Next, part of the pulled exposed liner edge is wedged into the retainer's tapered cut out segment which retains it in place.

It is the primary object of the present invention to provide for an improved liner retainer device.

Another object is to provide for such a device that is compact in construction, easy to use and inexpensive to manufacturer with no moving parts.

These and other objects and advantages of the present invention will become apparent to readers from a consideration of the ensuing description and the accompanying drawings.

DESCRIPTION OF THE PREFERRED EMBODIMENT

Figure 1:
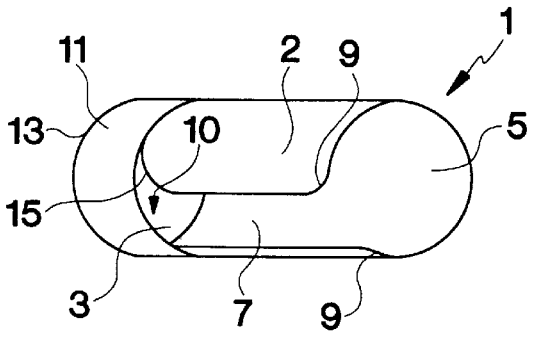
FIG. 1 is a side perspective view of the preferred embodiment of the invention's liner retainer.

FIG. 1 is a side perspective view of the preferred embodiment of the invention's liner retainer 1. The retainer consists of a longitudinally cylindrical hollow body 2 having a front 3, upper and lower sides 4 and a rear 5 open end. Extending along part of the body's side is a first longitudinal rectangular cut out segment 7 which is opened where it joins the rear opening 5 along the body's rear open edge 9. This rear edge 9 defines and outlines the limits of the hollow rear opening.

Nearer the body's front portion is a second smaller tapered cut out body segment 10 joins at its edges with and flows into the larger cut out body segment 7. This smaller cut out body portion 10 is oriented generally perpendicular to the first larger cut out segment and terminates in the body at the taper's end point 11. The edges forming the second cut out segment may be rounded, as shown, to provide a smooth interfacing joining edge with the joining body edges of the first larger cut out segment. The body's front opened edge 13 is generally parallel to most of the leading body edge 15 of the cut out body segment 10. Front circular edge 13 defines the front circular body opening 3. If desired, an elasticized paint indicated by the Xs may be provided on the exterior surface of body 2 near its front end to assist in the retaining of liner material the paint contacts when in place.

Figure 2:
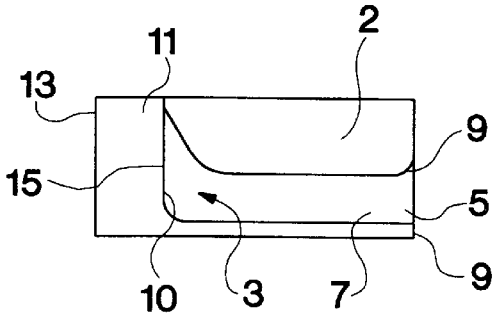
FIG. 2 is a side view of the FIG. 1 retainer.

FIG. 2 is a side view of the FIG. 1 retainer. In this view the orientation of the body's three edges 9, 13 and cut out edge 15 are depicted as being generally parallel to each other, although slight variations are possible. The upper and lower body edges 17 and 19, respectively, which partially define the limits of cut out 7, are oriented generally parallel to the upper and lower sides of the cylindrical body 2 and perpendicular to its two opposite end edges 9 and 13.

Figure 3:
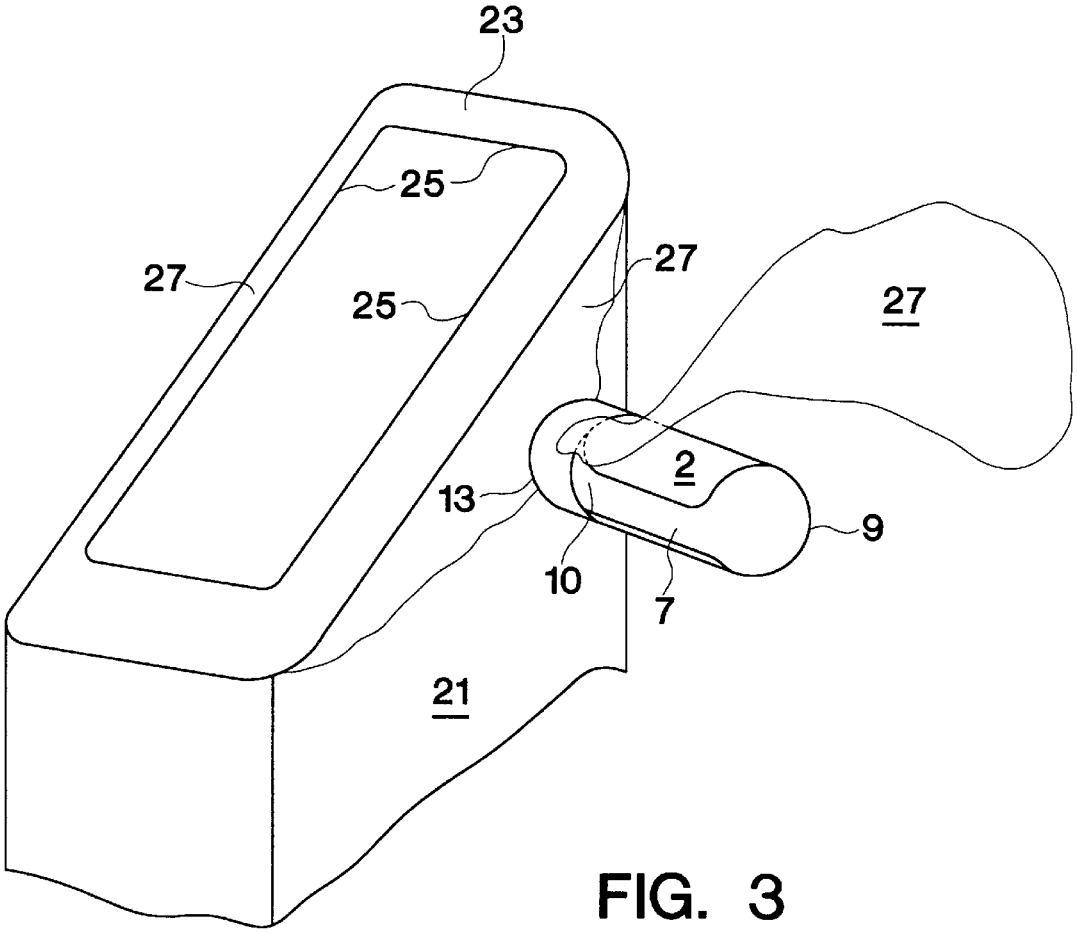
FIG. 3 shows a top perspective view of the retainer mounted on the side of a container with a liner mounted in it.

FIG. 3 shows a top perspective view of the retainer mounted on the side of a top opened garbage or trash container 21 with a removable liner 23 mounted within the interior of the container. Overlapping the container's opening rim 25 is the excess amount 27 of liner 23.

Typically the liner 23 is a removable, disposable, flexible plastic trash bag used to line the interior container surface and prevent liquids or other trash from adhering thereto while providing a convenient inner container that can be disposed of by the user. In this depiction the excess liner amount extends over all sides of the container's upper opened rim. A major portion of the excess liner is first pulled by a user's hand through the front retainer opening 13 and then into the cut out body segment 7 and finally pulled into the tapered segment 10 where it is wedged in a retaining position towards end segment point 11. The retainer's front end 13 is drawn towards the facing side of the container while the inherent counter reaction of the flexible pulled and now tensioned excess liner in the retainer 1 permits the retainer to stay in place against the container's side. The elasticized paint designated by Xs in all three figures will assist in retaining the liner's edge that is adjacent to the wedge/tapered shaped cut out segment 10 as this paint contacts the adjacent liner material.

In many situations the container's liner are plastic bags that are flexible and can be tensioned by pulling to a certain degree while providing for a counter force that seeks to restore them to their original non-tensioned shape. This counter force pulls the retainer towards the container and permits its flat side 13 to be mounted on the generally flat facing side of the container 21 without the need of additional support. All cut out edges that contact the excess liner should be smooth to prevent binding along the edge and tearing of the liner.

The body portion 2 making up the liner retainer, including the cut out segments, can be made in a variety of manufacturing methods with a variety of materials. If plastic is chosen for the body's material, the plastic injection molding process could be used to make the liner retainer. Injection molding is a plastic molding process whereby heat softened plastic material is forced under very high pressure into a metal cavity mold, usually aluminum or steel, which is relatively cool. The inside cavity of the mold is comprised of two or more halves, and is the same desired shape as the product to be formed (in this case the hollow retainer). High pressure hydraulics are used to keep the mold components together during the actual injection phase of the molding process. The injected plastic is allowed to cool and harden in the mold. The hydraulics holding the multiple component mold cavity together are released, the mold halves are separated and the solid formed plastic item is removed. Injection molding can be highly automated process and is capable of producing extremely detailed parts at a very cost effective price. The process should be invaluable in producing this invention's liner retainer cost effectively.

Although the present invention's preferred embodiment and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A liner retainer device adapted for use with a container comprising:

a hollow body having a front and a rear opened ends with a first side cut out segment and a second joined smaller cut out segment, said second cut out segment being tapered inwardly from where joined to the first cut out segment and oriented generally parallel to the body's front opened end.

2. The device as claimed in claim 1, wherein said body is cylindrically shaped and adapted to be held by a user's hand with the first cut out segment being shaped generally rectangular and extending partially along the length of the cylinder's body.

3. The device as claimed in claim 2, also including in combination with the device a container's flexible liner having an excess amount extending from the container wherein said excess liner can be pulled through the retainer's front end opening and wedged into the retainer's second cut out body segment.

4. The combination as claimed in claim 3, also including in additional combination an opened container with defining sides wherein part of said excess liner can be pulled through its hollow opening and into the second cut out segment, said retainer being mountable on a side of the container by abutting the retainer's front opened end there against whereby the excess pulled liner in retained in place with respect to the container.

5. The combination as claimed in claim 4, wherein said second cut out segment has tapered defining edges which converge to near a common point and diverge when meeting the edges of the first cut out segment.

6. A method for retaining the excess amount of a container liner to the container comprising the steps of:

(a) placing a liner within an opened rim container with the liner's excess amount extending over the container's rim;

(b) holding by hand a hollow exterior body member with two opened ends and joined cut out segments at least one of which segments is tapered inwardly and pulling part of the excess liner material through one of the body member's ends and into the tapered body cut out segment to wedge part of the material therein and retain the excess material; and (c) mounting one of the opened body ends against a container after step (b) is completed to retain the body and excess liner material against the side of the container in a tensioned state.

* * * * *